US007379691B2

(12) United States Patent
Lee

(10) Patent No.: US 7,379,691 B2
(45) Date of Patent: May 27, 2008

(54) CARRIER REMOVER DEVICE, A WET-TYPE IMAGE FORMING APPARATUS HAVING THE SAME, AND A METHOD FOR REMOVING CARRIER IN WET-TYPE IMAGE FORMING APPARATUS

(75) Inventor: Young-Sil Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 277 days.

(21) Appl. No.: 11/245,170

(22) Filed: Oct. 7, 2005

(65) Prior Publication Data

US 2006/0115301 A1 Jun. 1, 2006

(30) Foreign Application Priority Data

Nov. 30, 2004 (KR) ..... 10-2004-0099074

(51) Int. Cl.
*G03G 15/11* (2006.01)
*G03G 15/16* (2006.01)

(52) U.S. Cl. ..... 399/251; 399/101; 399/302

(58) Field of Classification Search ..... 399/302, 399/251, 101
See application file for complete search history.

(56) References Cited

U.S. PATENT DOCUMENTS 5,150,161 A * 9/1992 Bujese ..... 399/251
5,574,547 A * 11/1996 Denton et al. ..... 399/251
6,141,026 A * 10/2000 Domoto et al. ..... 399/251
6,745,002 B2 * 6/2004 Nakashima et al. ..... 399/302
6,748,189 B2 * 6/2004 Vejtasa et al. ..... 399/251
2002/0090232 A1 * 7/2002 Pang et al. ..... 399/251
2002/0098011 A1 * 7/2002 Tamiya et al. ..... 399/302
2002/0106220 A1 * 8/2002 Nakashima et al.
2004/0234298 A1 * 11/2004 Nukada et al. ..... 399/251

FOREIGN PATENT DOCUMENTS

| | | |
|---|---|---|
| KR | 1999-011208 | 3/1999 |
| KR | 1020000002773 | 1/2000 |
| KR | 2001-0047400 | 6/2001 |
| KR | 2001-0047620 | 6/2001 |
| KR | 2004-0047636 | 6/2004 |

* cited by examiner

*Primary Examiner*—Susan S Lee
(74) *Attorney, Agent, or Firm*—Roylance, Abrams, Berdo & Goodman, L.L.P.

(57) ABSTRACT

A carrier removing device of a wet-type image forming apparatus, according to an embodiment of the present invention, comprises an intermediate transfer medium and a vaporizing unit. The intermediate transfer medium receives images from an image carrying medium. The vaporizing unit evaporates, at a low temperature, a liquid carrier saturating the intermediate transfer medium.

14 Claims, 2 Drawing Sheets

CARRIER REMOVER DEVICE, A WET-TYPE IMAGE FORMING APPARATUS HAVING THE SAME, AND A METHOD FOR REMOVING CARRIER IN WET-TYPE IMAGE FORMING APPARATUS

CROSS-REFERENCE TO RELATED APPLICATIONS

This application claims the benefit under 35 U.S.C. § 119(a) of Korean Patent Application No. 2004-99074, filed Nov. 30, 2004, the entire contents of which are hereby incorporated by reference.

BACKGROUND OF THE INVENTION

1, Field of the Invention

The present invention relates to a method and apparatus for removing liquid carrier in an image forming apparatus. More particularly, the present invention relates to a method and apparatus for removing liquid carrier from an intermediate transfer medium by evaporating the carrier at a low temperature.

2, Description of the Related Art

In general, image forming apparatuses are classified into either dry-type image forming apparatuses that use a powder developer such as toner or wet-type image forming apparatuses that use a liquid developer, which is a mixture of powder toner and a liquid carrier.

Dry-type image forming apparatuses have the disadvantage that they produce toner dust, which can be messy and should not be consumed. Dry-type image forming apparatuses also have limitations with respect to the image quality of color images. As a consequence, research on wet-type image forming apparatuses has become more active.

Wet-type image forming apparatuses can be further classified as either monochrome image forming apparatuses that produce a single color image (typically, black) or color image forming apparatuses that produce a color image. Typical color image forming apparatuses use magenta, cyan, yellow and black developers to form a color image.

In a wet-type image forming apparatus, as is well known to those of ordinary skill in the art, an electrostatic latent image is formed on an image carrying medium by a laser beam projected by a laser scanning unit. Prior to scanning, the image carrying medium is electrically charged by an electrifying unit to a predetermined potential. The electrostatic latent image is developed using a developer and the developed image is transferred onto a printing medium to form a visible image. In color image forming apparatuses, a plurality of single color images are formed on a plurality of image carrying mediums by using developers of different colors. The single color images are transferred and overlapped onto an intermediate transfer medium, such as an intermediate transfer belt (ITB), to form a full-color image. The full-color image formed on the intermediate transfer medium is then transferred onto a printing medium. The printing medium with the transferred full-color image passes through a series of fixing processes and is then discharged from the image forming apparatus.

Here, the developer is an ink mixture having a predetermined color and comprising a magnetic powder toner and a liquid carrier. The ink is supplied to a developing unit through a dedicated ink cartridge, and developed on the electrostatic latent image formed on the image carrying medium.

However, in such a wet-type image forming apparatus, the intermediate transfer medium and the full-color image transferred onto the intermediate transfer medium may be saturated with the liquid carrier. The carrier included in the intermediate transfer medium is transferred to the printing medium together with the full-color image, thereby deteriorating transfer efficiency. In addition, the liquid carrier transferred onto the printing medium evaporates during a fixing process; however, large amounts of electricity are required to evaporate the carrier in the required short time frame. Furthermore, the processes and devices for collecting and purifying the evaporated carrier are complicated and increase manufacturing costs.

Accordingly, there is a need for an improved method and apparatus for removing liquid carrier in a wet-type image forming apparatus.

SUMMARY OF THE INVENTION

An aspect of the present invention is to solve at least the above problems and/or disadvantages and to provide at least the advantages described below. Accordingly, an aspect of the present invention is to provide a carrier removing device with a simple structure that is capable of removing carrier from an intermediate transfer medium, a wet-type image forming apparatus having the same, and a method for removing carrier in a wet-type image forming apparatus.

In an exemplary embodiment of the present invention, a carrier removing device for a wet-type image forming apparatus comprises an intermediate transfer medium and a vaporizing unit. The intermediate transfer medium receives an image from an image carrying medium. The vaporizing unit evaporates, at a low temperature, a liquid carrier saturating the intermediate transfer medium.

The vaporizing unit may comprise a high-frequency vibrator for generating high-frequency vibration, and a vibration plate for transmitting the vibration generated by the high-frequency vibrator to the intermediate transfer medium.

The vibration plate may be connected to the high-frequency vibrator so that it encloses opposite sides of the intermediate transfer medium.

The vibration plate may include clip parts for gripping the opposite sides of the intermediate transfer medium.

The clip parts may grip a non-image area of the intermediate transfer medium.

The vibration plate may be disposed on an inner surface of the intermediate transfer medium.

The carrier removing device may further comprise a power supply unit for applying high voltage to the vibration plate.

The carrier removing device may further comprise an insulator between the vibration plate and the high-frequency vibrator.

In another embodiment of the present invention, a wet-type image forming apparatus comprises a main body, an intermediate transfer medium, and a vaporizing unit. The main body mounts an image carrying medium, and an image from the image carrying medium is transferred to the intermediate transfer medium. The vaporizing unit evaporates, at a low temperature, a liquid carrier saturating the intermediate transfer medium. A carrier collecting unit is mounted in the main body to collect the vaporized carrier.

The vaporizing unit may comprise a high-frequency vibrator generating high-frequency vibration, and a vibration plate transmitting the vibration generated by the high-frequency vibrator to the intermediate transfer medium, and may further comprise a power supply unit for applying high voltage to the vibration plate.

The collecting unit may comprise a condenser member mounted in the main body to condense the low-temperature vaporized carrier, and a receptacle storing the carrier liquefied by the condenser member.

In another embodiment of the present invention, a method for removing carrier in a wet-type image forming apparatus comprises the steps of low-temperature vaporizing the carrier on the intermediate transfer medium, and collecting the vaporized carrier.

The vaporizing step may comprise the steps of generating high-frequency vibration, and transmitting the high-frequency vibration to the intermediate transfer medium.

The method may further comprise the step of, upon generation of the vibration, tightly contacting a toner image formed on the intermediate transfer medium onto the intermediate transfer medium.

The tightly contacting step may comprise the step of applying high voltage to the intermediate transfer medium.

BRIEF DESCRIPTION OF THE DRAWING FIGURES

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
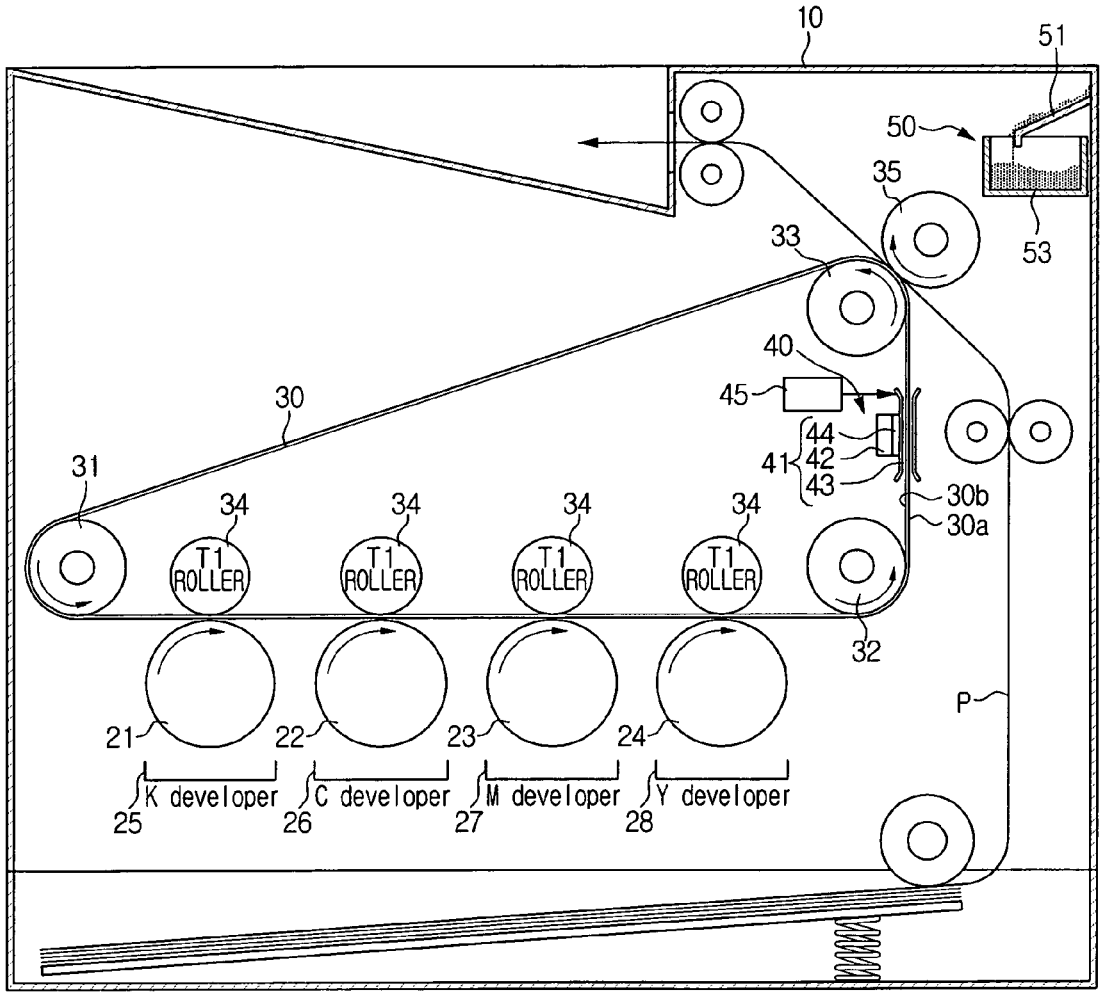
FIG. 1 is a configuration view of an image forming apparatus according to an embodiment of the present invention.

Referring to FIG. 1, a wet-type image forming apparatus according to an embodiment of the present invention comprises a main body 10, image carrying mediums 21, 22, 23, and 24 mounted within the main body 10 for respective colors, an intermediate transfer belt (ITB) 30 (which is an intermediate transfer medium), a carrier removing device 40, and a carrier collecting unit 50.

The image carrying mediums 21, 22, 23, and 24 are disposed in the main body 10 in a certain order of colors to form a full-color image. In this embodiment, the image carrying mediums 21, 22, 23, and 24 are arranged in order of black (K), cyan (C), magenta (M) and yellow (Y) along a running direction of the ITB 30.

Surfaces of the respective image carrying mediums 21, 22, 23, and 24 are electrically charged by an electrifying unit (not shown) to a predetermined potential. Electrostatic latent images are formed on the surfaces of the image carrying mediums 21, 22, 23, and 24 by a laser beam projected by a laser scanning unit (not shown).

Developing units 25, 26, 27, and 28 for the respective colors are disposed below the respective image carrying mediums 21, 22, 23 and 24 so as to form an image of each color on areas of the electrostatic latent images. The developing units 25, 26, 27, and 28 attach a developer onto the electrostatic latent image areas of the image carrying mediums 21, 22, 23, and 24 through generally-known developing processes. Since these processes are well-know to those skilled in the art, detailed description of the structure and operation of the developing units is omitted.

The ITB 30 is driven in one direction, being supported by a driving roller 31, supporting rollers 32 and 33, and a plurality of first transfer rollers 34. The ITB 30 is driven by the driving roller 31. Color images are formed on the respective image carrying mediums 21, 22, 23, and 24 and transferred onto the ITB 30 in sequence so that they overlap. Thus, a full-color image is transferred onto the surface of the ITB 30 after it has passed through the yellow image carrying medium 24. The full-color image is then transferred onto a printing medium P which is passed through a space between the ITB 30 and a second transfer roller 35.

The carrier removing device 40 comprises a vaporizing unit 41 for evaporating a carrier saturating the ITB 30 at a low temperature, and a power supply unit 45.

The vaporizing unit 41 comprises a high-frequency vibrator 42, a vibration plate 43, and an insulator 44. The high-frequency vibrator 42 generates high-frequency vibration upon application of electric current.

Figure 2:
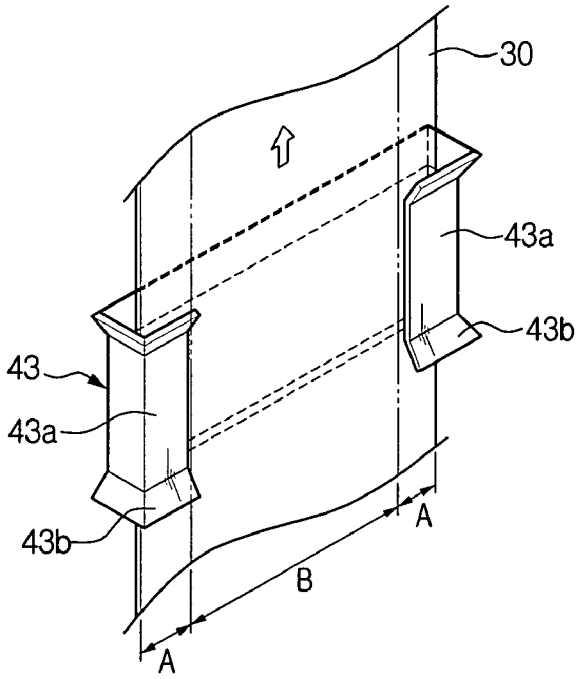
FIG. 2 is a perspective extraction view of the vibration plate shown in FIG. 1.
Figure 3:
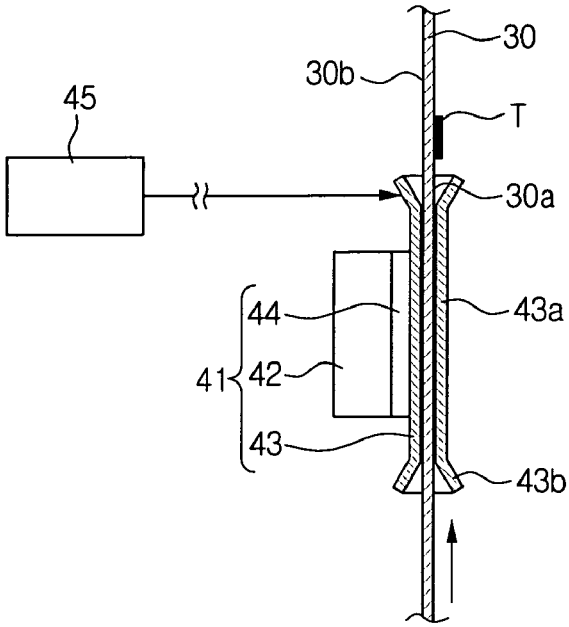
FIG. 3 is a sectional view showing certain elements of FIG. 1.

The vibration plate 43 transmits the vibration generated at the high-frequency vibrator 42 to the ITB 30. More specifically, referring to FIGS. 2 and 3, the vibration plate 43 tightly contacts an inner surface 30*b* corresponding to an outer surface 30*a* of the ITB 30. The vibration plate 43 has clip parts 43a which grip opposite sides of the ITB 30. The clip parts 43*a* enclose and grip the inner and the outer surfaces 30*a* and 30*b* of the ITB 30. More particularly, the clip parts 43*a* grip a non-image area 'A' formed on opposite sides of an image area 'B'. Also, the vibration plate 43 has slant guides 43*b* which help reduction of friction and entrance of the ITB 30 when the ITB 30 enters between the clip parts 43*a*, The slant guides 43*b* are also provided to the opposite ends of the clip parts 43*a*.

The high-frequency vibrator 42 and the vibration plate 43 are connected to each other with the insulator 44 therebetween. Accordingly, the high-frequency vibration generated at the high-frequency vibrator 42 is transmitted to the ITB 30 through the vibration plate 43. For more efficient transmission of the high-frequency vibration during running of the ITB 30, the vibration plate 43 is preferably formed as a broad plate. Thus, the liquid carrier saturating the ITB 30 is vaporized at a low temperature by the high-frequency vibration transmitted to the ITB 30 through the vibration plate 43.

The power supply unit 45 is connected with the vibration plate 43 to apply high voltage to the vibration plate 43. The high voltage applied from the power supply unit 45 is transmitted to the ITB 30. The image transferred onto the ITB 30 is brought into more tight contact with the ITB 30 by the high voltage transmitted to the ITB 30. Therefore, the image can be prevented from being scattered or separated from the ITB 30 by the high-frequency vibration during removal of the carrier. In other words, the high voltage generates electrostatic forces which hold the toner image into tight contact with the ITB 30. Therefore, the toner image is protected from the high-frequency vibration.

Furthermore, the ITB 30 more tightly contacts the vibration plate 43 due to the high voltage applied to the vibration plate 43. Accordingly, the high-frequency vibration of the vibration plate 32 can be more efficiently transmitted to the ITB 30, thereby effectively removing the carrier even during the short contact time that occurs when the ITB 30 runs at a high speed.

The carrier collecting unit 50 comprises a condenser member 51 mounted in the main body 10 of the image forming apparatus and a receptacle 53 for storing the liquid carrier condensed in the condenser member 51. Preferably, the condenser member 51 is formed of metal having high thermal conductivity. Since carrier vapor is formed by being vaporized at a low temperature by the high-frequency vibration, the carrier vapor can be liquefied using the condenser member 51 without requiring a dedicated air-conditioner. The liquefied carrier is collected into the receptacle 53 disposed under the condenser member 51, thereby being stored within the main body 10. The receptacle 53 is preferably detachably formed to easily dispose of the collected carrier.

The operation of the wet-type image forming apparatus according to an embodiment of the present invention will now be described.

First, the developers of the respective colors are attached onto the image carrying mediums 21, 22, 23, and 24 using the electrifying unit, the laser scanning unit and the developing units 25, 26, 27, and 28.

The color developers on the image carrying mediums 21, 22, 23, and 24 are transferred onto the ITB 30 so that they overlap one another, thereby forming a full-color image. The full-color image includes both toner and liquid carrier. During transfer, much of the liquid carrier is transferred from the image carrying mediums 21, 22, 23, and 24 to the ITB 30.

Thus, the carrier removing device 40 removes the carrier included in the ITB 30. In greater detail, electricity is applied to the high-frequency vibrator 42 to generate a high-frequency vibration. The high-frequency vibration is transmitted through the vibration plate 43 to the ITB 30. The carrier included in the ITB 30 is vaporized, at a low temperature, by the high-frequency vibration.

When the high-frequency vibrator 42 is driven, the power supply unit 45 applies the high voltage to the vibration plate 43. The full-color image on the ITB 30 tightly contacts the ITB 30 due to the high voltage. As a result, the full-color image is protected from the high-frequency vibration. Also, since the ITB 30 tightly contacts the vibration plate 43 due to the high voltage applied to the vibration plate 43, the high-frequency vibration from the vibration plate 43 is efficiently transmitted to the ITB 30.

The vapor of the low-temperature vaporized carrier, moving in the main body 10, attaches to the condense member 51 and is thereby liquefied. Because the vaporization is performed at a low temperature, the carrier vapor can be liquefied at room temperature. The liquefied carrier is collected and stored in the receptacle 53.

As can be appreciated from the above description of the carrier removing device and the wet-type image forming apparatus having the same, according to embodiments of the present invention, the carrier included in the ITB 30 can be removed by vaporizing the carrier at a low temperature using high-frequency vibration.

Accordingly, a dedicated heating system to evaporate the carrier at a high temperature is not necessary, and also, a dedicated device for removing heat caused by the evaporation is not required.

Moreover, since the low-temperature vaporized carrier vapor can be condensed at room temperature without a dedicated air-conditioner, the number of parts and manufacturing cost can be reduced.

While the invention has been shown and described with reference to certain embodiments thereof, it will be understood by those skilled in the art that various changes in form and details may be made therein without departing from the spirit and scope of the invention as defined by the appended claims.

What is claimed is:

1. A carrier removing device for a wet-type image forming apparatus, comprising:

an intermediate transfer medium that receives an image transferred from an image carrying medium; and a vaporizing unit for evaporating at a low temperature a liquid carrier saturating the intermediate transfer medium;

wherein the vaporizing unit comprises:

a high-frequency vibrator for generating high-frequency vibration; and a vibration plate for transmitting the vibration generated by the high-frequency vibrator to the intermediate transfer medium.

2. The carrier removing device of claim 1, wherein the vibration plate is connected to the high-frequency vibrator so that it encloses opposite sides of the intermediate transfer medium.

3. The carrier removing device of claim 2, wherein the vibration plate includes clip parts for gripping the opposite sides of the intermediate transfer medium.

4. The carrier removing device of claim 3, wherein the clip parts grip a non-image area of the intermediate transfer medium.

5. The carrier removing device of claim 1, wherein the vibration plate is disposed on an inner surface of the intermediate transfer medium.

6. The carrier removing device of claim 1, further comprising:

a power supply unit for applying high voltage to the vibration plate.

7. The carrier removing device of claim 1, further comprising:

an insulator between the vibration plate and the high-frequency vibrator.

8. A wet-type image forming apparatus comprising:

a main body mounting an image carrying medium;

an intermediate transfer medium that receives an image transferred from an image carrying medium; and a vaporizing unit for evaporating at a low temperature a liquid carrier saturating the intermediate transfer medium;

wherein the vaporizing unit comprises:

a high-frequency vibrator for generating high-frequency vibration; and a vibration plate for transmitting the vibration generated by the high-frequency vibrator to the intermediate transfer medium.

9. The wet-type image forming apparatus of claim 8, further comprising:

a carrier collecting unit mounted in the main body to collect the vaporized carrier.

10. The wet-type image forming apparatus of claim 9, wherein the carrier collecting unit comprises:

a condenser member mounted in the main body to condense the low-temperature vaporized carrier; and a receptacle storing the carrier liquefied by the condenser member.

11. The wet-type image forming apparatus of claim 8, further comprising:

a power supply unit for applying high voltage to the vibration plate.

12. A method for removing carrier in a wet-type image forming apparatus, comprising the steps of:

vaporizing the carrier on an intermediate transfer medium at a low-temperature; and collecting the vaporized carrier;

wherein the vaporizing step comprises the steps of:

generating high-frequency vibration; and transmitting the high-frequency vibration to the intermediate transfer medium.

13. The method of claim 12, further comprising the step of:

tightly contacting a toner image formed on the intermediate transfer medium onto the intermediate transfer medium upon generation of the vibration.

14. The method of claim 13, wherein the tightly contacting step comprises the step of:

applying high voltage to the intermediate transfer medium.

* * * * *